US009635926B2

(12) United States Patent
Fujikawa et al.

(10) Patent No.: US 9,635,926 B2
(45) Date of Patent: May 2, 2017

(54) STORAGE CASE

(71) Applicant: FUJITSU LIMITED, Kawasaki-shi, Kanagawa (JP)

(72) Inventors: Hideyuki Fujikawa, Kawasaki (JP); Tomohiro Takizawa, Chigasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/287,427

(22) Filed: Oct. 6, 2016

(65) Prior Publication Data

US 2017/0020272 A1 Jan. 26, 2017

Related U.S. Application Data

(63) Continuation of application No. PCT/JP2014/060757, filed on Apr. 15, 2014.

(51) Int. Cl.
*A45F 5/02* (2006.01)
*A45C 11/00* (2006.01)

(52) U.S. Cl.
CPC ..... *A45F 5/021* (2013.01); *A45C 11/00* (2013.01); *A45C 2011/002* (2013.01); *A45C 2011/003* (2013.01); *A45F 2200/0516* (2013.01); *A45F 2200/0525* (2013.01)

(58) Field of Classification Search
CPC ... A45C 13/02; A45C 2013/025; A45C 11/00; A45C 2011/002; A45F 2011/002
USPC ..... 224/196
See application file for complete search history.

(56) References Cited

U.S. PATENT DOCUMENTS 1,344,635 A * 6/1920 Hill ..... A24F 15/12 206/254
1,388,073 A * 8/1921 Stewart ..... A24F 15/18 206/259
1,463,619 A * 7/1923 Gardner ..... A63F 1/06 150/141
1,832,625 A * 11/1931 Gardner, Jr. ..... A45C 1/06 150/141

(Continued)

FOREIGN PATENT DOCUMENTS

JP 3043044 U 11/1997
JP 3082297 U 12/2001

(Continued)

OTHER PUBLICATIONS

International Search Report dated Jul. 8, 2014, issued in counterpart International Application No. PCT/JP2014/060757 (2 pages).

(Continued)

*Primary Examiner* — Justin Larson
(74) *Attorney, Agent, or Firm* — Westerman, Hattori, Daniels & Adrian, LLP

(57) ABSTRACT

A storage case includes a case body that stores a storage item, a pull-out member that, upon being pulled out from the case body, moves the storage item stored in the case body toward an outside of the case body, and a fold portion that is provided at the pull-out member. The pull-out member is folded at the fold portion and separated from an extraction section of the storage item so as to expose the extraction section in a state in which the extraction section of the storage item is positioned outside the case body.

6 Claims, 10 Drawing Sheets

(56) References Cited

U.S. PATENT DOCUMENTS

| | | | | |
|---|---|---|---|---|
| 2,988,209 | A * | 6/1961 | Parrilla | A45C 13/02 206/307 |
| 3,212,689 | A * | 10/1965 | Woolfolk | F42B 39/02 206/254 |
| 3,589,505 | A | 6/1971 | Burniski | |
| 4,541,556 | A * | 9/1985 | Collins | A45F 5/02 206/250 |
| 5,341,973 | A * | 8/1994 | Dawes | A45F 3/04 221/185 |
| 6,948,600 | B2 * | 9/2005 | Chuang | A45C 3/02 150/116 |
| 7,699,196 | B2 * | 4/2010 | Szabo | A45F 5/02 224/196 |
| 7,918,371 | B2 * | 4/2011 | Wilson | F41A 9/65 224/196 |
| 8,151,981 | B2 * | 4/2012 | Nordstrom | A45C 7/0077 206/254 |
| 8,726,953 | B2 * | 5/2014 | Paulsen | A45C 11/182 150/131 |
| 9,320,341 | B2 * | 4/2016 | Majeau | A45F 3/04 |
| 2008/0035506 | A1 * | 2/2008 | Rostami | A45C 11/00 206/320 |
| 2011/0011754 | A1 | 1/2011 | Nordstrom | |

FOREIGN PATENT DOCUMENTS

| | | | | |
|---|---|---|---|---|
| JP | EP 1224886 | A1 * | 7/2002 | A45C 11/182 |
| JP | 2003-325219 | A | 11/2003 | |
| JP | 2005-143988 | A | 6/2005 | |
| JP | 2008-86385 | A | 4/2008 | |
| WO | 2009/114858 | A2 | 9/2009 | |

OTHER PUBLICATIONS

Written Opinion of the International Search Authority dated Jul. 8, 2014, issued in counterpart International Application No. PCT/JP2014/060757 (w/partial English translation) (5 pages).

* cited by examiner

STORAGE CASE

CROSS-REFERENCE TO RELATED APPLICATION

This application is a continuation application of International Application No. PCT/JP2014/060757, filed Apr. 15, 2014, the disclosure of which is incorporated herein by reference in its entirety.

FIELD

The embodiments discussed herein are related to a storage case.

BACKGROUND

An existing storage structure for small objects includes a belt member having one end fixed, at a specific height, to a second surface opposing a first surface of a bag body, and having an intermediate section that is brought down toward a bottom surface of the bag body and folded back so as to enable a small object to be stored between the belt member and a retaining section.

RELATED PATENT DOCUMENTS

Japanese Laid-Open Patent Publication No. 2003-325219

SUMMARY

According to an aspect of the embodiments, a storage case includes a case body that stores a storage item, a pull-out member that, upon being pulled out from the case body, moves the storage item stored in the case body toward an outside of the case body, and a fold portion. The fold portion is provided at the pull-out member, and the pull-out member is folded at the fold portion and separated from an extraction section of the storage item so as to expose the extraction section in a state in which the extraction section of the storage item is positioned outside the case body.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

A first exemplary embodiment is explained in detail below, based on the drawings.

Figure 1:
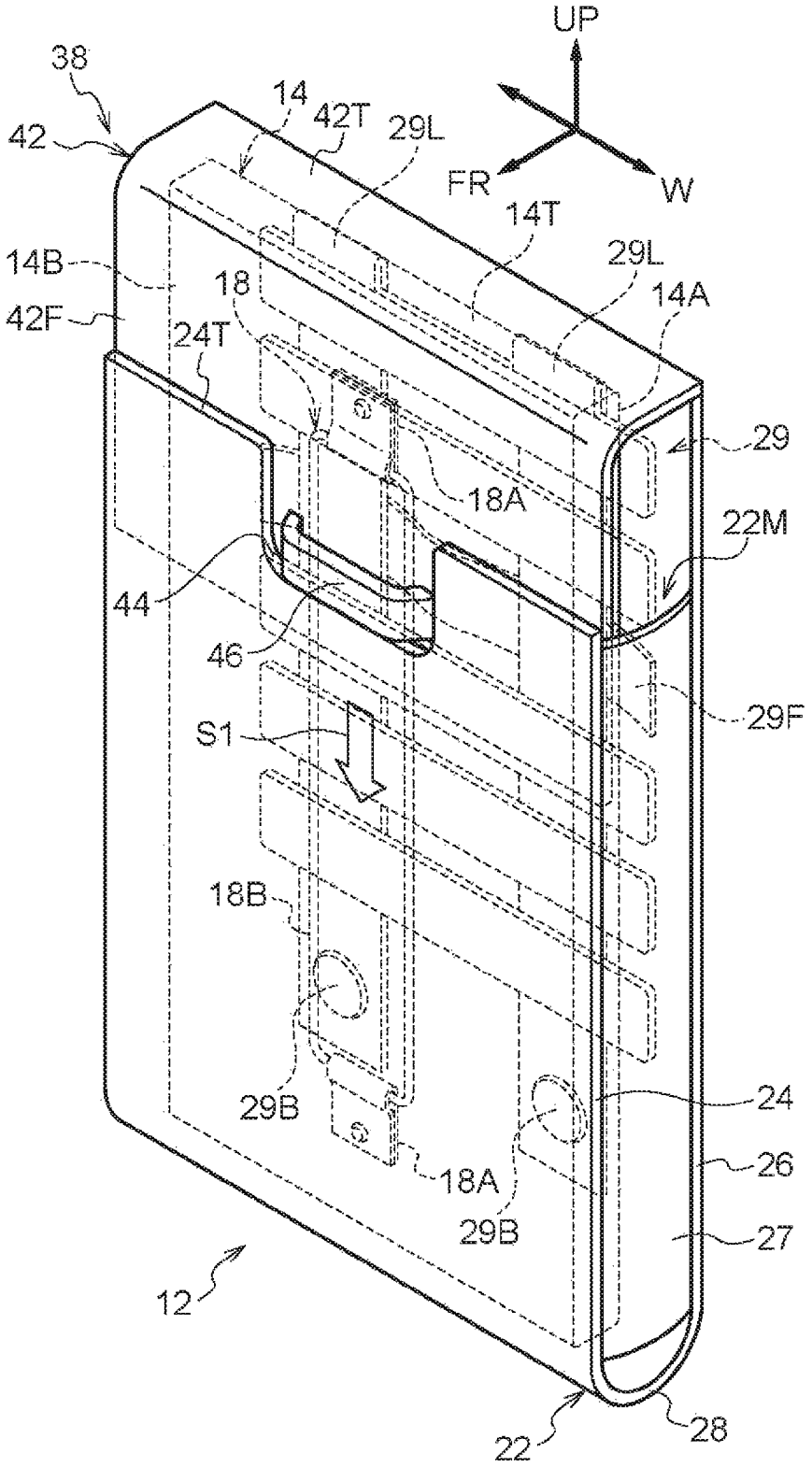
FIG. 1 is a perspective view illustrating a storage case of a first exemplary embodiment, together with a storage item.
Figure 2:
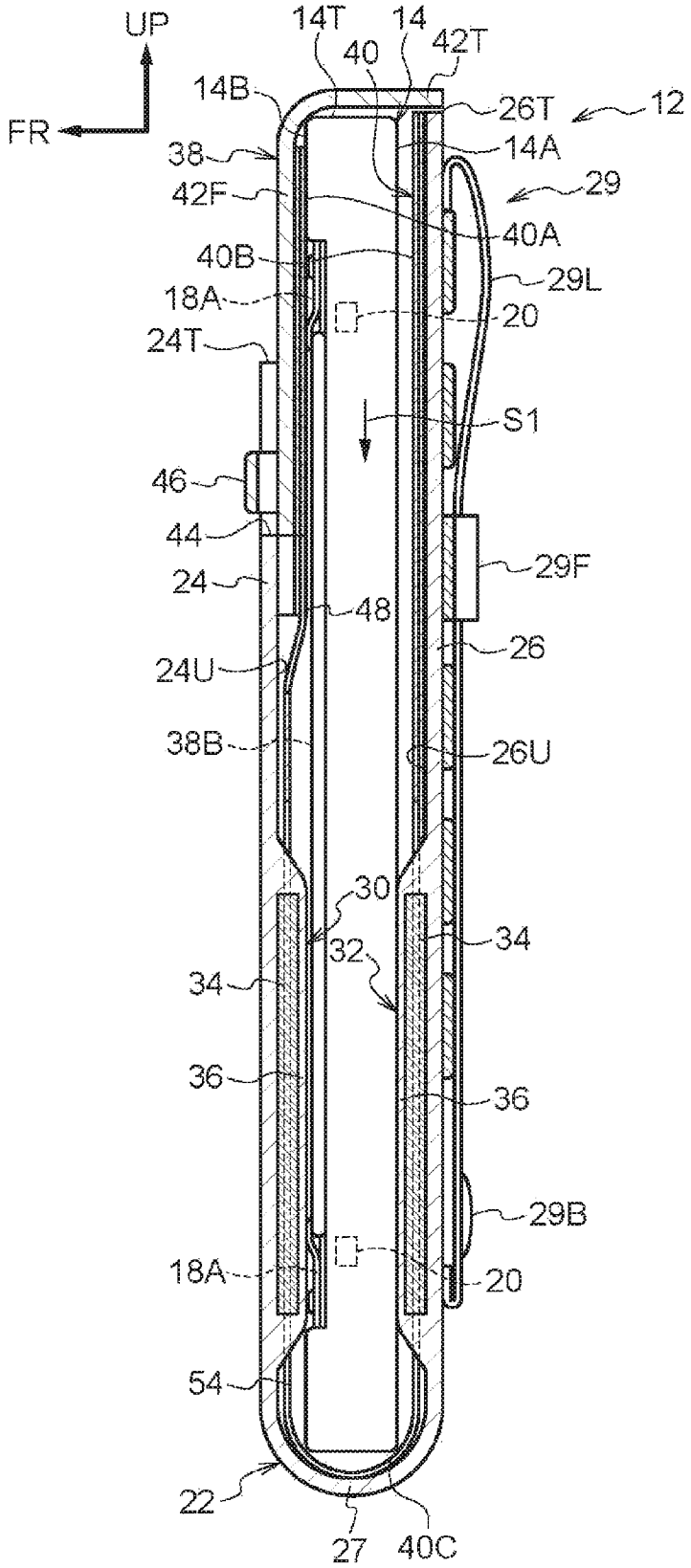
FIG. 2 is a vertical cross-section illustrating a storage case of the first exemplary embodiment, together with a storage item.

FIG. 1 and FIG. 2 illustrate a storage case 12 of the first exemplary embodiment. The storage case 12 is capable of storing a storage item 14, such as, for example, tablet style portable terminal, a smartphone, or a cellphone. The storage item 14 can be inserted into, or taken out of, the storage case 12 while the storage case 12 is in a worn state by a user on their clothing or the like.

The storage case 12 includes a belt that allows the storage case 12 to be worn by the user. In the below explanation, "front side" refers to the side of the storage case 12 that is furthest from the belt (the side that is furthest from the user). In the below explanation, "upper direction" refers to the upper direction while the storage case 12 is in a worn state by the user. In each of the drawings, the upper direction, front direction, and width direction of the storage case 12 are respectively indicated by the arrow UP, the arrow FR, and the arrow W.

As illustrated in FIG. 2, the storage item 14 of the present exemplary embodiment includes a display surface 14A and a cover surface 14B. The display surface 14A includes a display, for example. The cover surface 14B includes an extraction section 18. In the example illustrated in FIG. 1 and FIG. 2, the extraction section 18 includes an upper and lower pair of fabric retainers 18A that are attached to the cover surface 14B, and a grip cord 18B that spans between the fabric retainers 18A. The extraction section 18 is a member that the user can hook a finger or the like onto in a case of extracting the storage item 14 from the storage case 12.

As illustrated in FIG. 2, the inside of the storage item 14 of the present exemplary embodiment includes magnetic sensors 20. In cases in which a magnetic force (magnetic flux density) detected by the magnetic sensors 20 is a specific value or greater, the storage item 14 transitions to an energy saving state, such as a power-off state or a standby state. The magnetic sensors 20 are provided at an upper portion and a lower portion inside the storage item 14. Even if the storage item 14 is stored inside the storage case 12 in an upside-down state, the magnetic force of magnet bodies 34, described later, can be detected.

The storage case 12 includes a case body 22 that stores the storage item 14. The case body 22 of the present exemplary embodiment includes a front plate 24 and a rear plate 26, which have rigidity to bending. The front plate 24 and the rear plate 26 are coupled together by side portions 27 and a bottom portion 28, and the case body 22 has a substantially rectangular box shape including an insertion opening 22M that opens upward. As is clear from FIG. 2, in the present exemplary embodiment, an upper end 24T of the front plate 24 is lower than an upper end 26T of the rear plate 26.

A belt passage section 29 is provided at a rear surface side of the rear plate 26. In the example illustrated in FIG. 1, the belt passage section 29 includes two belt loops 29L extending along the up-down direction, and a pressing member 29F that presses up-down direction intermediate portions of the belt loops 29L toward the rear plate 26. An upper portion of each belt loop 29L is fixed to the rear plate 26, and a lower portion of each belt loop 29L is fixed by a fastener 29B to the rear plate 26 so as to be capable of being detached therefrom. The user is able to wear the storage case 12 by, for example, suitably setting an up-down position of the pressing member 29F, and inserting the belt of the user through a gap between the belt loops 29L and the rear plate 26.

The storage item 14 is inserted into the storage case 12 through the insertion opening 22M. The insertion direction of the storage item 14 is indicated by the arrow S1.

Magnet members 30, 32 are provided at respective inner surfaces 24U, 26U of the front plate 24 and the rear plate 26. The magnet members 30, 32 each include the magnet body 34 and a magnet retaining section 36. The magnet member 30 is an example of a first magnet member, and the magnet member 32 is an example of a second magnet member. The magnet members 30, 32 are examples of detected members.

Figure 3:
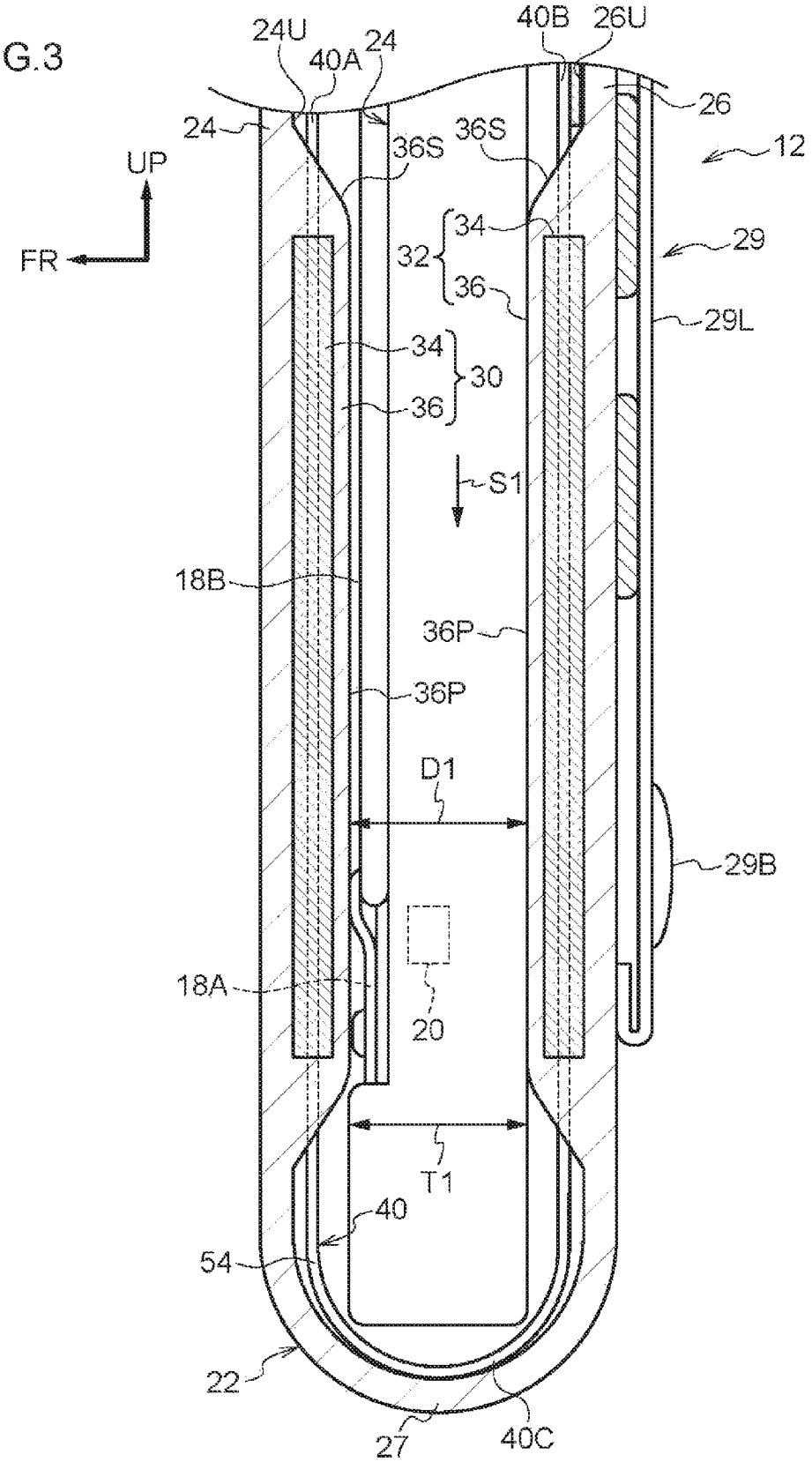
FIG. 3 is a vertical cross-section illustrating a partially enlarged storage case of the first exemplary embodiment, together with a storage item.

As is also illustrated in detail in FIG. 3, the magnet retaining sections 36 are respectively formed on the inner surface 24U of the front plate 24 and the inner surface 26U of the rear plate 26, and extend out inside the case body 22 from the inner surfaces 24U, 26U. Gaps are formed between the magnet retaining sections 36 and the inner surfaces 24U, 26U. Each magnet retaining section 36 covers the respective magnet body 34, and retains the magnet body 34 inside the gap.

Each magnet retaining section 36 includes a pressing portion 36P and a sloped portion 36S. The two pressing portions 36P surface each other inside the case body 22. The sloped portions 36S slope, with respect to the insertion direction of the storage item 14 (the arrow S1 direction), away from the respective pressing portions 36P. In a case in which the storage item 14 is inserted into the case body 22 and contacts the sloped portions 36S, the storage item 14 is guided toward the center of the case body 22 by the sloped portions 36S. Even if the storage item 14 hits hard against the magnet retaining sections 36, the shock thereof is alleviated by the sloped portions 36S.

In the present exemplary embodiment, a distance D1 between the two pressing portions 36P is substantially the same as a thickness T1 of the storage item 14. In a case in which the storage item 14 is positioned between the magnet members 30, 32, sometimes the pressing portions 36P are pressed by the storage item 14 due to the thickness T1 of the storage item 14, such that the magnet retaining sections 36 flex slightly, and the distance D1 widens. The pressing portions 36P press against, and are in close contact with, the storage item 14 due to reaction force against the flexing of the magnet retaining sections 36, thereby enabling a distance between the storage item 14 and each magnet body 34 to be stably maintained. In cases in which the thickness T1 of the storage item 14 is thinner than the distance D1 between the two pressing portions 36P, the magnet members 30, 32 do not contact the storage item 14, but the magnet bodies 34 are maintained in a state close to the storage item 14.

Each magnet body 34 is formed in an elongated shape (a flat rectangular bodied shape), and the length direction of the magnet body 34 runs along the insertion direction of the storage item 14 (the arrow S1 direction). In a fully stored state in which the entire storage item 14 is stored inside the storage case 12 (see FIG. 2), a position at a lower end of each magnet body 34 is a position where magnetic force of a specific value or greater acts on the magnetic sensors 20. Even in a partially stored state in which a lower side portion of the storage item 14 is stored inside the storage case 12 (see FIG. 6), a position at an upper end of each magnet body 34 is a position where magnetic force (magnetic flux density) of a specific value or greater reaches the magnetic sensors 20. Namely, the length (up-down direction range) of each magnet body 34 is a length that causes magnetic flux density of a specific value or greater at the magnetic sensors 20, whatever the position of the storage item 14 between the fully stored position and the partially stored position.

In the present exemplary embodiment, the two magnet members 30, 32 are provided, and the pair of magnet bodies 34 surface each other with the storage item 14 stored in the storage case 12 therebetween. In particular, the magnet bodies 34 are disposed in orientations in which opposite magnetic poles (N poles and S poles) surface each other. Thus, there is greater magnetic flux density in the space between the magnet bodies 34, and there is less spatial variation in the magnetic flux density, compared, for example, to a structure in which the magnet bodies 34 are disposed orientated with the same magnetic poles facing each other. The magnetic flux density outside the storage case 12 is smaller than that between the magnet bodies 34.

A pull-out member 38 is provided inside the storage case 12. As is also illustrated in detail in FIG. 4 and FIG. 8, the pull-out member 38 includes an inner cloth 40 formed of a flexible material, and a pull-out lid 42 formed of a material having rigidity to bending.

The inner cloth 40 includes a movable portion 40A and a fixed portion 40B, and also includes a continuation portion 40C that continues from the movable portion 40A and the fixed portion 40B. The continuation portion 40C links the movable portion 40A and the fixed portion 40B together at a leading end side thereof in the insertion direction of the storage item 14 (the arrow S1 direction).

The fixed portion 40B is sewn to the inner surface 26U of the rear plate 26 and fixed to the rear plate 26. In contrast thereto, the movable portion 40A runs along the inner surface 24U of the front plate 24, and is capable of moving along the insertion direction (arrow S1 direction) and the opposite direction thereto. There is continuity between a lower end of the fixed portion 40B and a lower end of the movable portion 40A through the continuation portion 40C, so as to form the integrated inner cloth 40.

In a case in which the storage item 14 is inserted into the case body 22 from the insertion opening 22M side, the storage item 14 passes between the movable portion 40A and the fixed portion 40B, and contacts the continuation portion 40C. In cases in which the continuation portion 40C is not in contact with the bottom portion 28 in this state, the continuation portion 40C and the movable portion 40A move downward upon the continuation portion 40C being pressed downward by the storage item 14.

In a case in which, from the fully stored state of the storage item 14 (see FIG. 1), the movable portion 40A is moved upward, the continuation portion 40C also moves upward, such that the storage item 14 that is being supported by the continuation portion 40C also moves upward. However, since the fixed portion 40B of the inner cloth 40 is fixed to the rear plate 26 and is immobile, the amount of upward movement of the movable portion 40A is limited to a specific range in which the fixed portion 40B does not come away from the rear plate 26.

The pull-out lid 42 is attached to the movable portion 40A. The pull-out lid 42 has rigidity to bending, and includes a front lid portion 42F attached to a front side upper portion of the movable portion 40A, and an upper lid portion 42T bending (at substantially a right angle in the example illustrated in FIG. 2) from an upper end of the front lid portion 42F.

As illustrated in FIG. 2, in the fully stored state of the storage item 14, the movable portion 40A of the inner cloth 40 and the pull-out lid 42 are down, and the front lid portion 42F surfaces the cover surface 14B of the storage item 14. The upper lid portion 42T surfaces an upper surface 14T of the storage item 14.

Note that an engagement portion, magnet, or the like may be provided that engages the upper lid portion 42T with the case body 22 so as to enable the orientation of the upper lid portion 42T facing the upper surface 14T of the storage item 14 to be maintained in the fully stored state of the storage item 14.

The upper end 24T of the front plate 24 is formed with a cutout portion 44 indented downward at the center in the arrow W direction (width direction). The cut-out portion 44 is configured such that the front plate 24 does not impinge on a handle portion 46 formed to the front lid portion 42F, and so as to expose the vicinity of the handle portion 46 through the front plate 24 in the fully stored state, such that it is easier to hook a finger or the like onto the handle portion 46.

There is a local change in the rigidity to bending of the movable portion 40A of the inner cloth 40 at a boundary between a portion that is attached to the pull-out lid 42 and a portion that is not attached thereto. A fold portion 48 is formed to the inner cloth 40 at this portion where rigidity to bending changes.

In the fully stored state illustrated in FIG. 2, the front lid portion 42F and the front plate 24 partially overlap each other. In this state, the front lid portion 42F is maintained in a state facing the storage item 14 without the movable portion 40A being folded at the fold portion 48.

Figure 5:
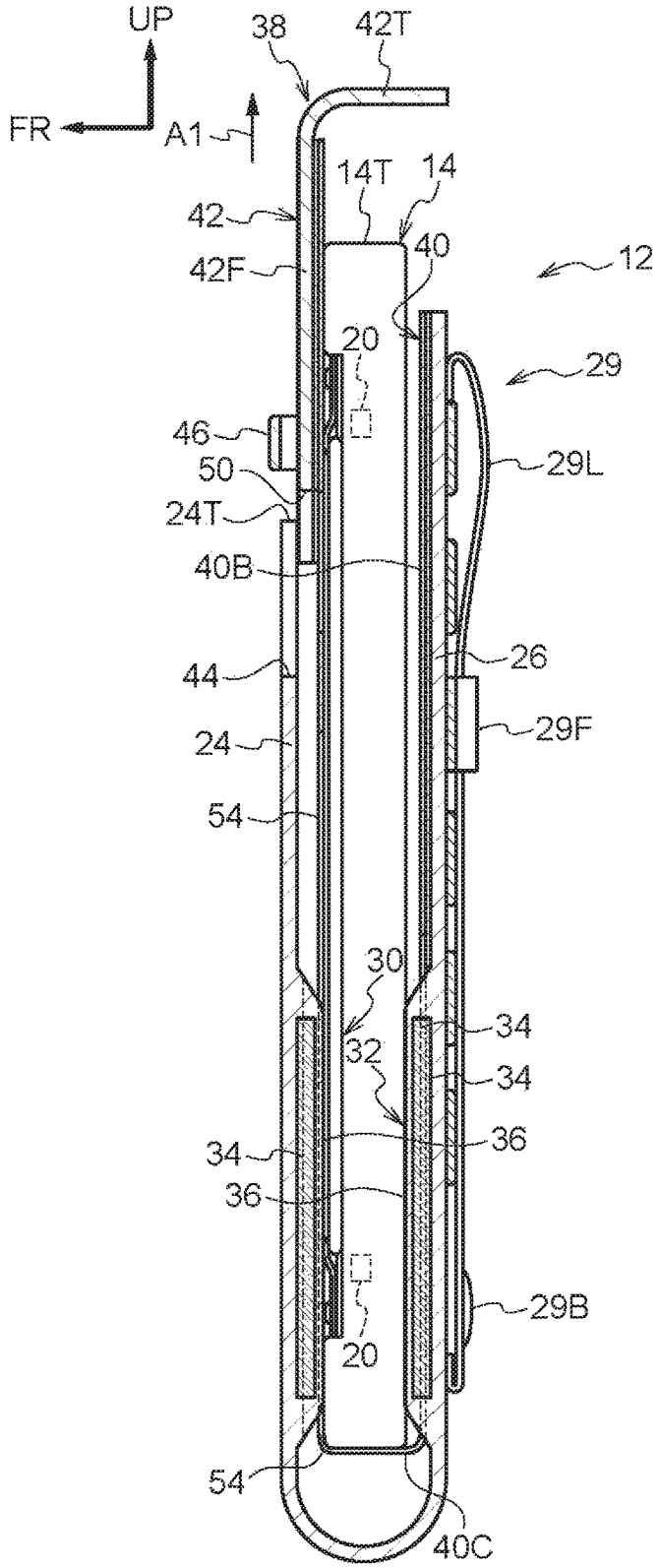
FIG. 5 is a vertical cross-section illustrating a storage case of the first exemplary embodiment, together with a storage item.

As illustrated in FIG. 5, in a case in which the pull-out lid 42 is pulled out in the arrow A1 direction, the front lid portion 42F is maintained in a state facing the storage item 14, without the movable portion 40A being folded at the fold portion 48, as long as part of the front lid portion 42F and the front plate 24 overlap each other.

Figure 7:
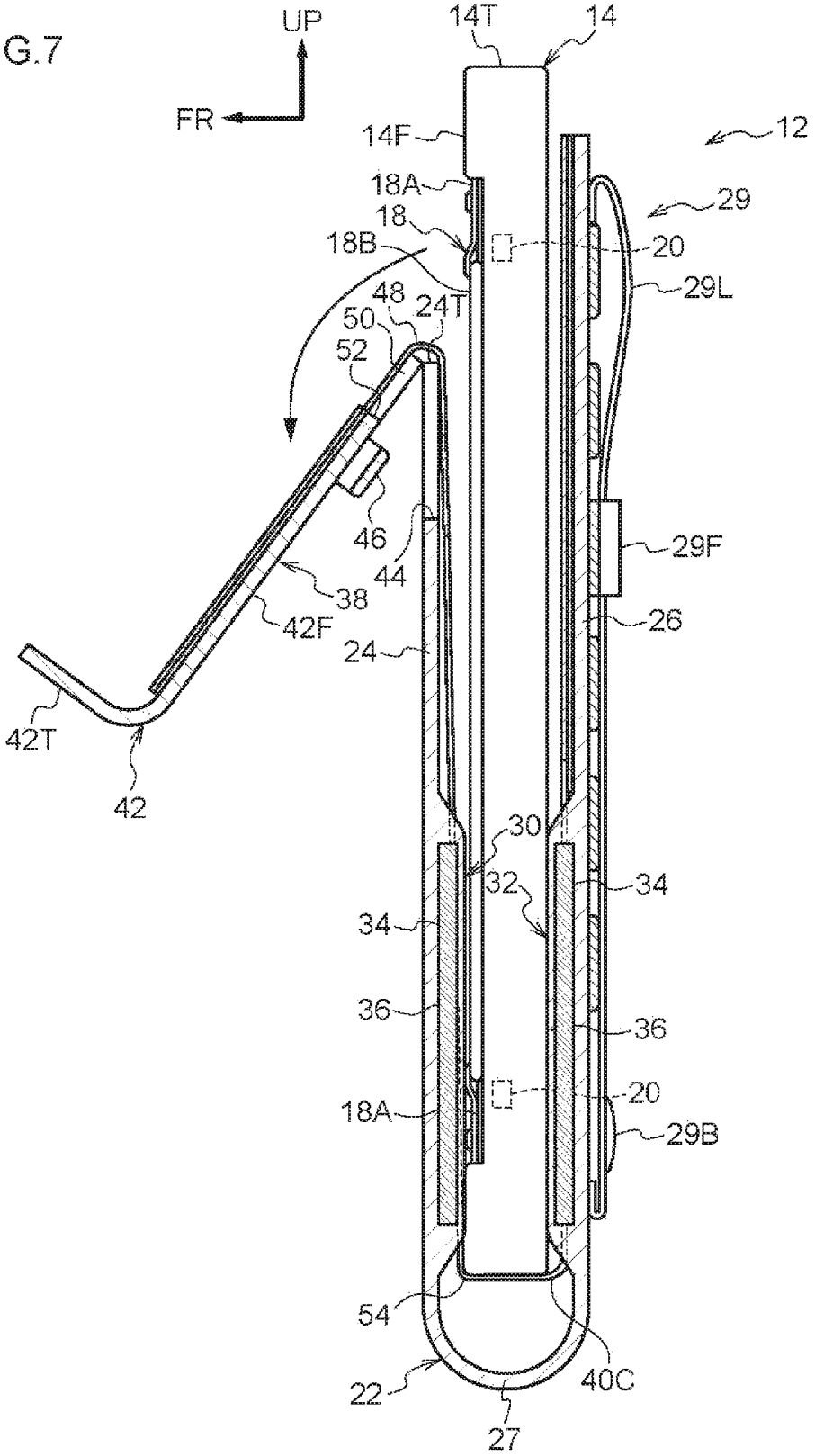
FIG. 7 is a vertical cross-section illustrating a storage case of the first exemplary embodiment, together with a storage item.

In contrast thereto, as illustrated in FIG. 7, in a case in which the entire pull-out lid 42 is positioned further upward than the front plate 24 of the case body 22, the movable portion 40A is capable of folding at the fold portion 48. The front lid portion 42F moves away from the storage item 14 due to the movable portion 40A folding at the fold portion 48. Part of the extraction section 18 of the storage item 14 is thereby exposed.

Figure 6:
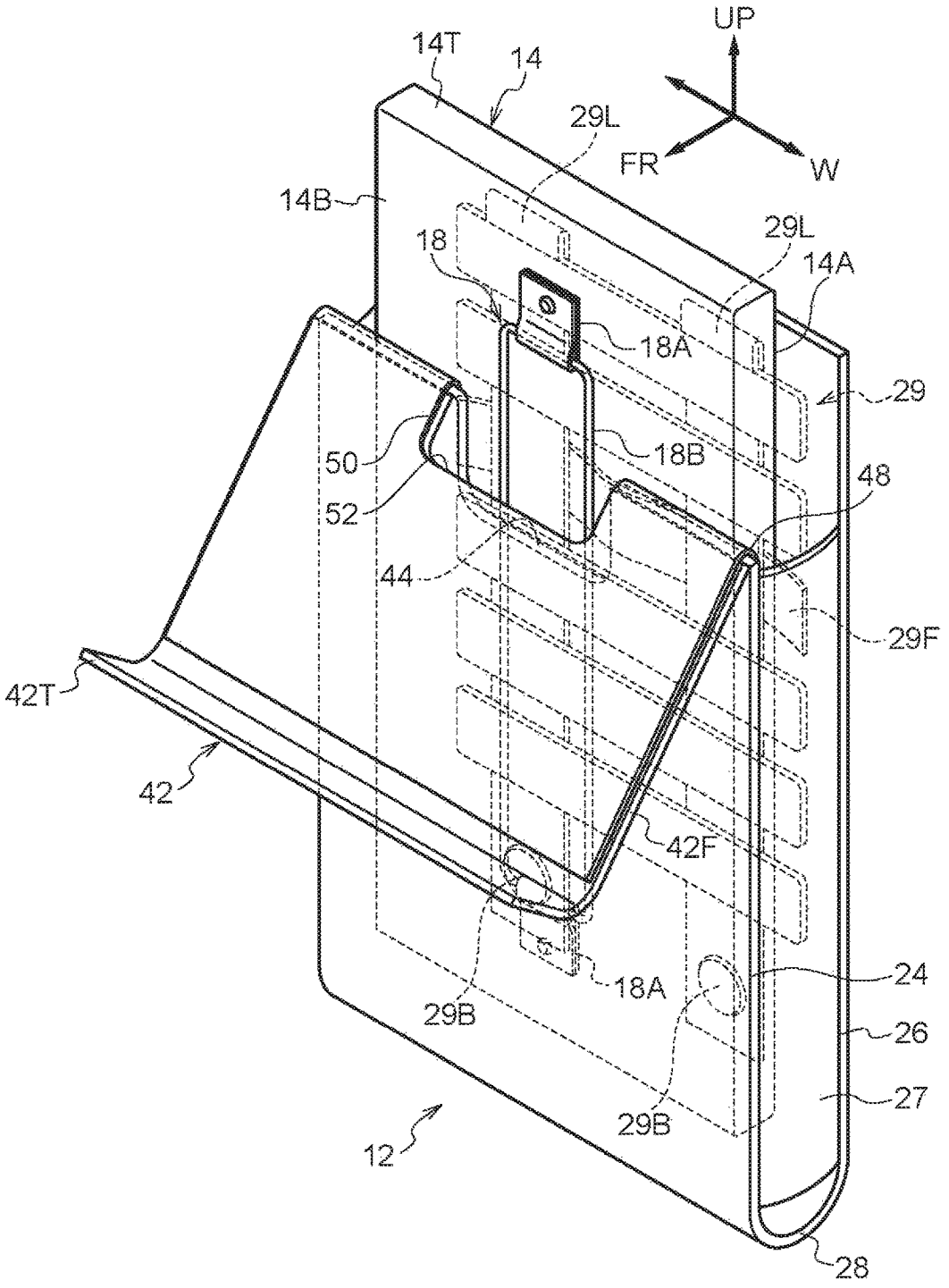
FIG. 6 is a perspective view illustrating a storage case of the first exemplary embodiment, together with a storage item.

As illustrated in FIG. 6 and FIG. 7, in the state in which the pull-out member 38 (movable portion 40A) has been folded at the fold portion 48, part of the pull-out member 38 (a part that is close to the fold portion 48) hooks onto the insertion opening 22M of the case body 22 (the upper end 24T of the front plate 24). Specifically, part of the pull-out member 38 surfaces the upper end 24T of the front plate 24 in the direction in which the pull-out member 38 is inserted inside the case body 22 (the same direction as the arrow S1 direction).

Figure 4:
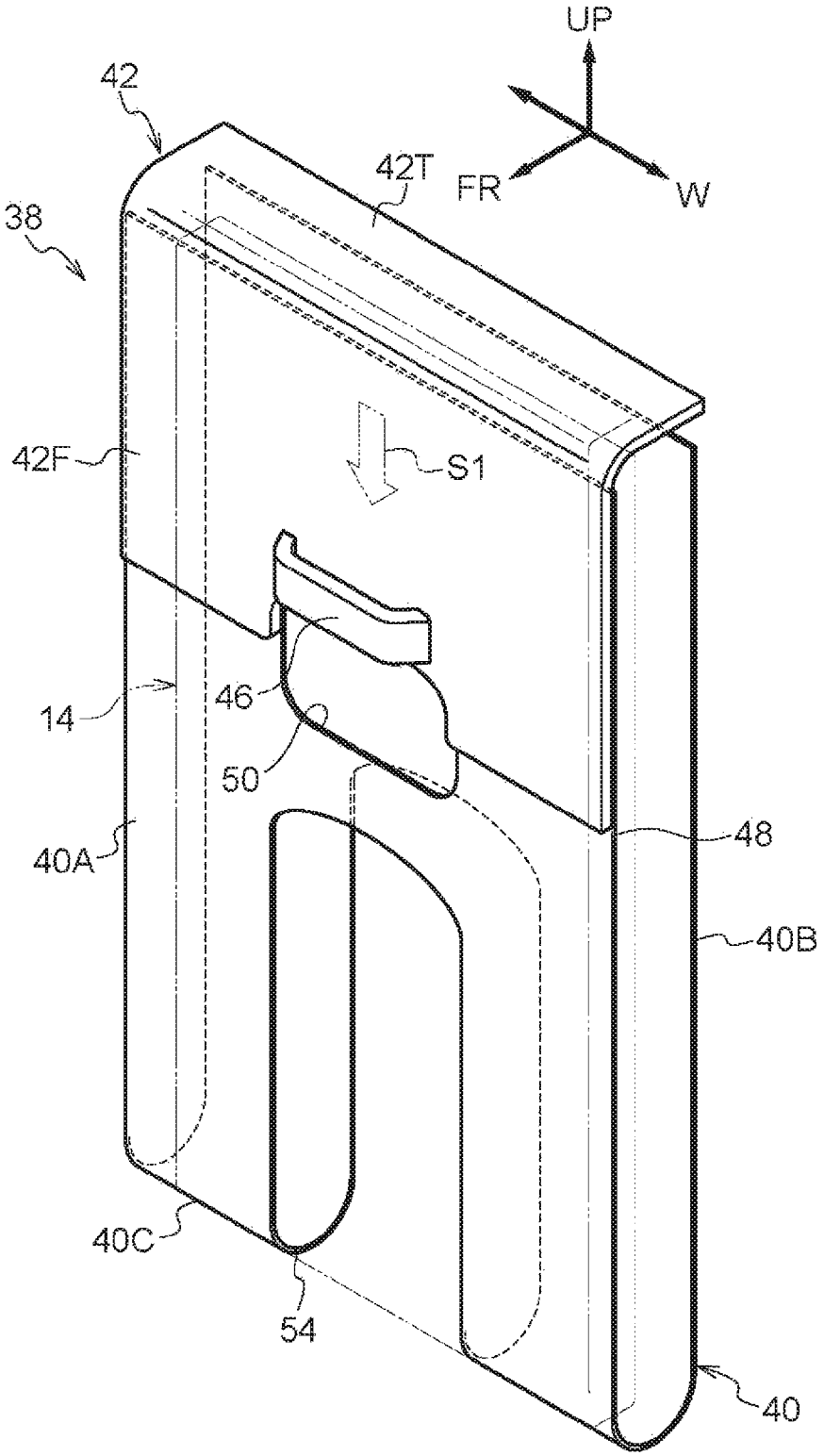
FIG. 4 is a perspective view illustrating a pull-out member of a storage case of the first exemplary embodiment, together with a storage item.
Figure 8:
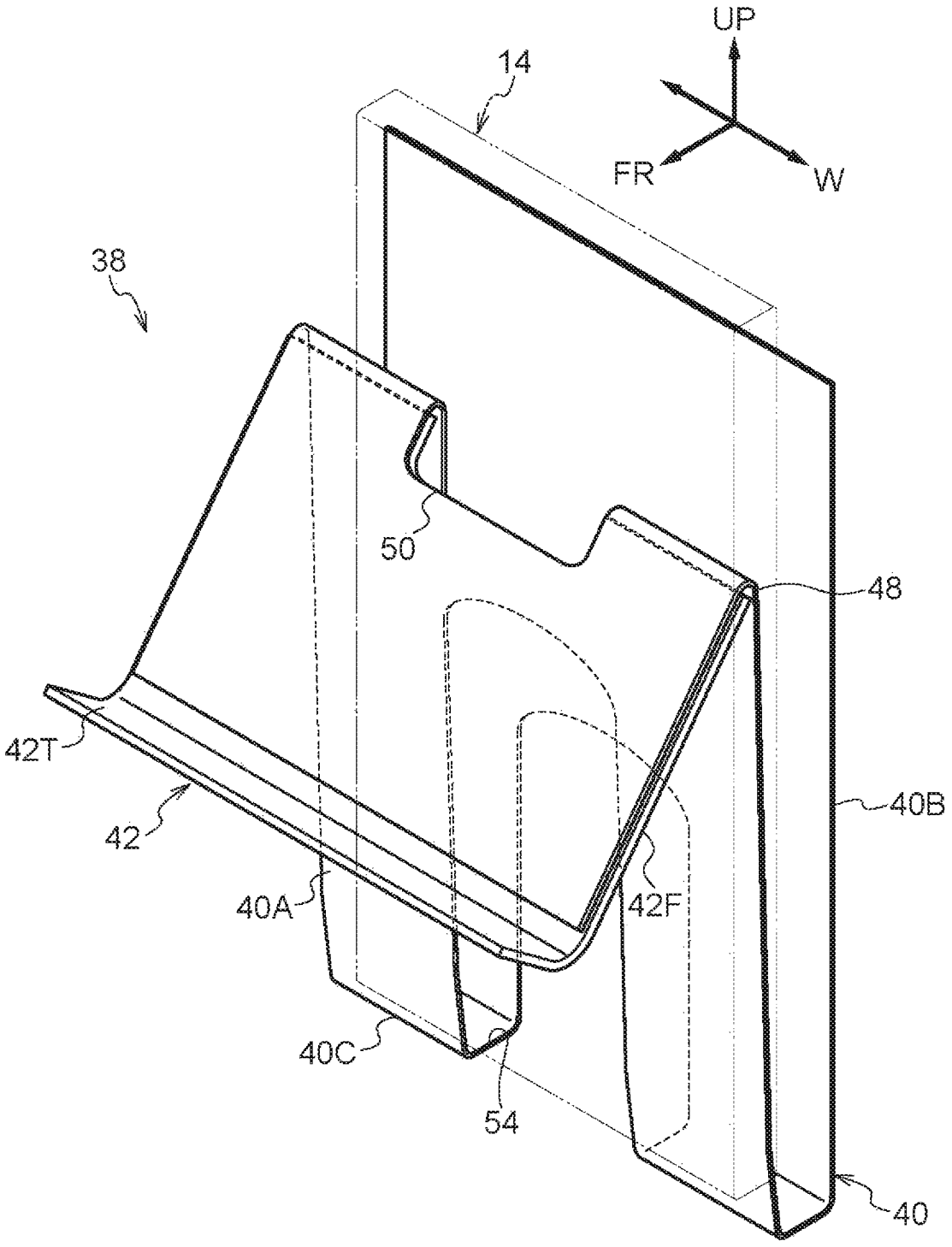
FIG. 8 is a perspective view illustrating a pull-out member of a storage case of the first exemplary embodiment, together with a storage item.

As illustrated in FIG. 4 and FIG. 8, an elliptical shaped exposure hole 50 with length along the arrow W direction is formed in the pull-out member 38 at the position of the fold portion 48. More specifically, an elliptical shaped hole is formed in the movable portion 40A at the fold portion 48, and an indentation corresponding to an upper half of the elliptical shaped hole is formed in a lower edge of the front lid portion 42F.

As is clear from FIG. 6 and FIG. 7, in a case in which the pull-out member 38 is folded at the fold portion 48, the exposure hole 50 becomes an indented portion 52 indented downward at a width direction center portion of the pull-out member 38. The indented portion 52 exposes the extraction section 18 of the storage item 14 over a wider range at a position corresponding to the cutout portion 44.

As is clear from FIG. 4 and FIG. 8, a hole section 54 is formed in the inner cloth 40 at a position where the inner cloth 40 avoids the magnet members 30, 32. In particular, in the present exemplary embodiment, the movable portion 40A of the inner cloth 40 moves in the arrow S1 direction, thereby changing the relative positions of the movable portion 40A and the magnet member 30. The hole section 54 is formed large enough that the inner cloth 40 does not overlap the magnet member 30, even in a case in which a change occurs in the relative position of the hole section 54. In particular, the present exemplary embodiment has a structure in which there is continuity between a hole section avoiding the magnet member 30 and a hole section avoiding the magnet member 32, so as to avoid both the magnet members 30, 32 with the single hole section 54, in a structure in which there is no overlap between the inner cloth 40 and the magnet members 30, 32.

Explanation follows regarding operation of the present exemplary embodiment.

As illustrated in FIG. 1 to FIG. 3, in the state in which the storage item 14 has been stored inside the storage case 12 (the fully stored state), the pressing portions 36P of the magnet retaining sections 36 are in close contact with the storage item 14, and the storage item 14 is sandwiched and retained between the magnet members 30, 32. The pressing portions 36P press the storage item 14 due to reaction force against being pressed by the storage item 14, such that the magnet bodies 34 are suppressed from being unintentionally distanced from the magnetic sensors 20 of the storage item 14. This enables a distance between the magnetic sensors 20 of the storage item 14 and the magnet bodies 34 to be stably maintained. The magnetic sensors 20 detect the magnetic force of the magnet bodies 34, thereby enabling the storage item 14 to be reliably maintained in the energy saving state.

In the present exemplary embodiment, the pressing portions 36P of the magnet retaining sections 36 press against the storage item 14 so as to sandwich the storage item 14. Thus, even if a gap occurs between the upper surface 14T of the storage item 14 and the upper lid portion 42T, for example, the pressing portions 36P press against the storage item 14 and friction occurs, thereby enabling up-down movement of the storage item 14 inside the storage case 12 to be suppressed.

The length directions of the magnet bodies 34 run along the insertion direction of the storage item 14 (the arrow S1 direction). Thus, even in cases in which the storage item 14 has moved up or down inside the storage case 12, a state is easily maintained in which the magnetic sensors 20 are positioned within a range reached by the magnetic force of the magnet bodies 34.

Figure 10:
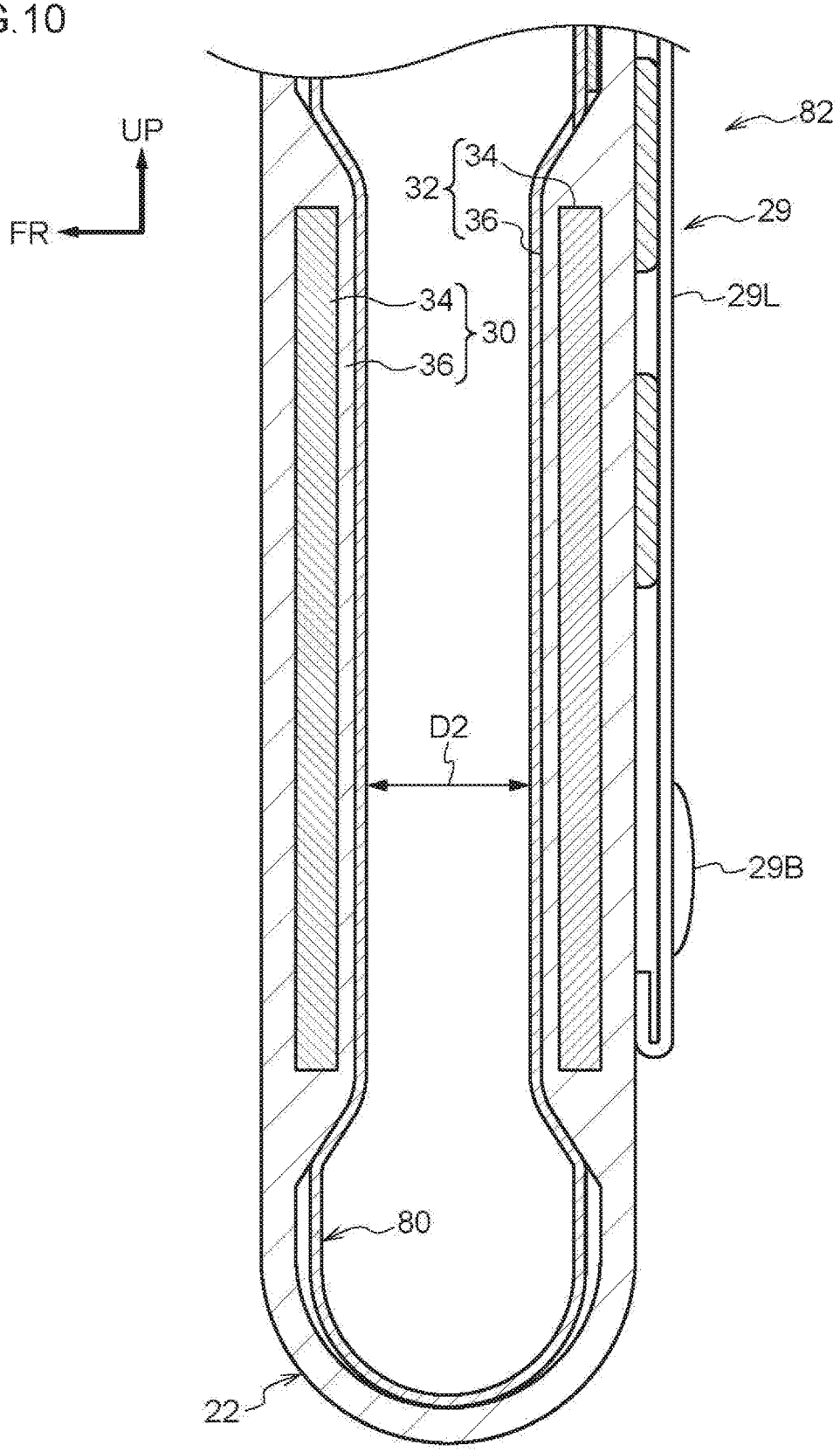
FIG. 10 is a vertical cross-section illustrating a partially enlarged storage case of a comparative example.

Note that FIG. 10 illustrates a storage case 82 of a comparative example including an inner cloth 80 that is not formed with the hole section 54. In the inner cloth 80 of the comparative example, part of the inner cloth 80 is present so as to cover the magnet members 30, 32. Thus a distance D2 between the magnet members 30, 32 where a storage item is sandwiched is narrower than the distance D1 of the first exemplary embodiment by an amount of twice the thickness of the inner cloth 80. In a case in which the storage item 14 with the thickness T1 (see FIG. 2) is positioned between the magnet members 30, 32, the magnet members 30, 32 are deformed in directions moving away from each other, and positions of the magnet bodies 34 are further away from the magnetic sensor 20. Moreover, there is increased resistance in a case in which the storage item 14 is inserted between the magnet members 30, 32, such that there is a concern that the storage item 14 or the magnet members 30, 32 might incur damage during insertion.

In contrast thereto, in the present exemplary embodiment, the hole section 54 is formed in the inner cloth 40, and the inner cloth 40 avoids the magnet members 30, 32 due to the hole section 54. Thus, the magnet bodies 34 can be set closer to the magnetic sensors 20 of the storage item 14 than in the inner cloth 80 of the comparative example.

In a case in which the storage item 14 is being inserted between the magnet members 30, 32, resistance to this insertion is smaller than in the structure of the comparative example. Damage to the storage item 14 or the magnet members 30, 32 can also be suppressed.

Note that, in a case in which the thickness T1 of the storage item 14 is thin, sometimes the pressing portions 36P of the magnet retaining sections 36 do not contact the storage item 14. However, even in such cases, the magnet retaining sections 36 project out inside the storage case 12, namely, toward the storage item 14, and the magnet bodies 34 are in positions near to the magnetic sensors 20, thereby enabling a state to be realized in which the magnetic sensors 20 easily detect the magnetic force of the magnet bodies 34.

In the present exemplary embodiment, the sloped portions 36S are respectively formed to the magnet retaining sections 36. The sloped portions 36S slope with respect to the insertion direction of the storage item 14 (the arrow S1 direction). This enables the storage item 14 to be guided inside the storage case 12 (the arrow S1 direction) in a case in which the storage item 14 has hit the sloped portions 36S. Even if the storage item 14 hits hard against the sloped portions 36S, the shock thereof can be alleviated due to the slope of the sloped portions 36S, enabling damage to the magnet retaining sections 36 to be suppressed compared to a structure in which the sloped portions 36S are not formed.

In the present exemplary embodiment, the magnet members 30, 32 each include the magnet body 34 and the magnet retaining section 36. Each magnet body 34 is retained by the respective magnet retaining section 36, thereby enabling damage to the magnet bodies 34 to be suppressed compared to a structure without the magnet retaining sections 36.

In order to take the storage item 14 out of the storage case 12, the pull-out member 38 (pull-out lid 42) is pulled out (moved in the arrow A1 direction) from the case body 22. In a case in which this is performed, the vicinity of the handle portion 46 of the pull-out member 38 is exposed through the cutout portion 44 of the front plate 24, such that the pull-out operation of the pull-out member 38 is easy.

In the present exemplary embodiment, the pull-out member 38 (inner cloth 40) has a structure in which there is continuity between the movable portion 40A and the fixed portion 40B through the continuation portion 40C. Thus, the storage item 14 is pressed upward by the continuation portion 40C in the pull-out operation of the pull-out member 38, enabling the storage item 14 to be moved along the arrow A1 direction.

As illustrated in FIG. 5, even in a state in which the pull-out member 38 has been pulled out, the pull-out member 38 does not fold at the fold portion 48 as long as the front lid portion 42F of the pull-out lid 42 and the front plate 24 overlap each other. The length directions of the magnet bodies 34 run along the insertion direction of the storage item 14 (the arrow S1 direction), and the magnetic sensors 20 of the storage item 14 are in the range reached by the magnetic force of the magnet bodies 34. Thus, the magnetic force of the magnet bodies 34 can be reliably detected by the magnetic sensors 20, and the storage item 14 can be reliably maintained in the energy saving state.

As illustrated in FIG. 6 and FIG. 7, in a case in which the pull-out member 38 is pulled out further, and the entire front lid portion 42F is positioned further upward than the front plate 24, the pull-out member 38 can be folded at the fold portion 48. Folding the pull-out member 38 at the fold portion 48 moves the pull-out member 38 away from the extraction section 18 of the storage item 14 and exposes the extraction section 18, such that it is easy to pull the storage item 14 out from the storage case 12.

In the present exemplary embodiment, the pull-out member 38 includes the movable portion 40A, and the fold portion 48 is provided at the movable portion 40A. Thus, an operation to move the movable portion 40A along the arrow A1 direction positions the fold portion 48 at the exterior of the case body 22, enabling the movable portion 40A (part of the pull-out member 38) to be placed in a state capable of being folded.

In particular, in a case in which the extraction section 18 of the storage item 14 moves toward the outside of the case body 22, the pull-out lid 42 provided at the movable portion 40A is positioned outside the case body 22. This enables the pull-out member 38 to be folded at the fold portion 48 such that the entire pull-out lid 42 moves away from the extraction section 18.

The hole section 54 of the inner cloth 40 is formed large enough to correspond to the relative movement range of the magnet member 30, even in a case in which the movable portion 40A moves along the S1 direction such that the relative position of the hole section 54 to the magnet member 30 with respect to the movable portion 40A changes. Thus, even in a case in which the position of the storage item 14 changes from the state illustrated in FIG. 2 (the fully stored state) to the state illustrated in FIG. 7, the inner cloth 40 does not overlap the magnet member 30. This enables a state in which the magnet bodies 34 are close to the magnetic sensors 20 of the storage item 14 to be maintained.

In a case in which the movable portion 40A has moved with respect to the case body 22 as described above, the fixed portion 40B is fixed to the case body 22 and so the fixed portion 40B does not move. Thus, the inner cloth 40 does not overlap the magnet member 32, regardless of the state of the inner cloth 40. The hole section 54 of the inner cloth 40 is continuous from a position avoiding the magnet member 30 to a position avoiding the magnet member 32. It is thereby sufficient to form a single hole section 54 without forming hole portions (two hole portions) corresponding to the respective magnet members 30, 32, such that the inner cloth 40 is easily formed.

The two magnet bodies 34 are disposed such that opposite magnetic poles surface each other, such that the magnetic flux density in the space between the magnet bodies 34 is larger and there is also less spatial variation in the magnetic flux density. This enables the magnetic sensors 20 to reliably detect the magnetic flux density between the magnet members 30, 32.

Figure 9:
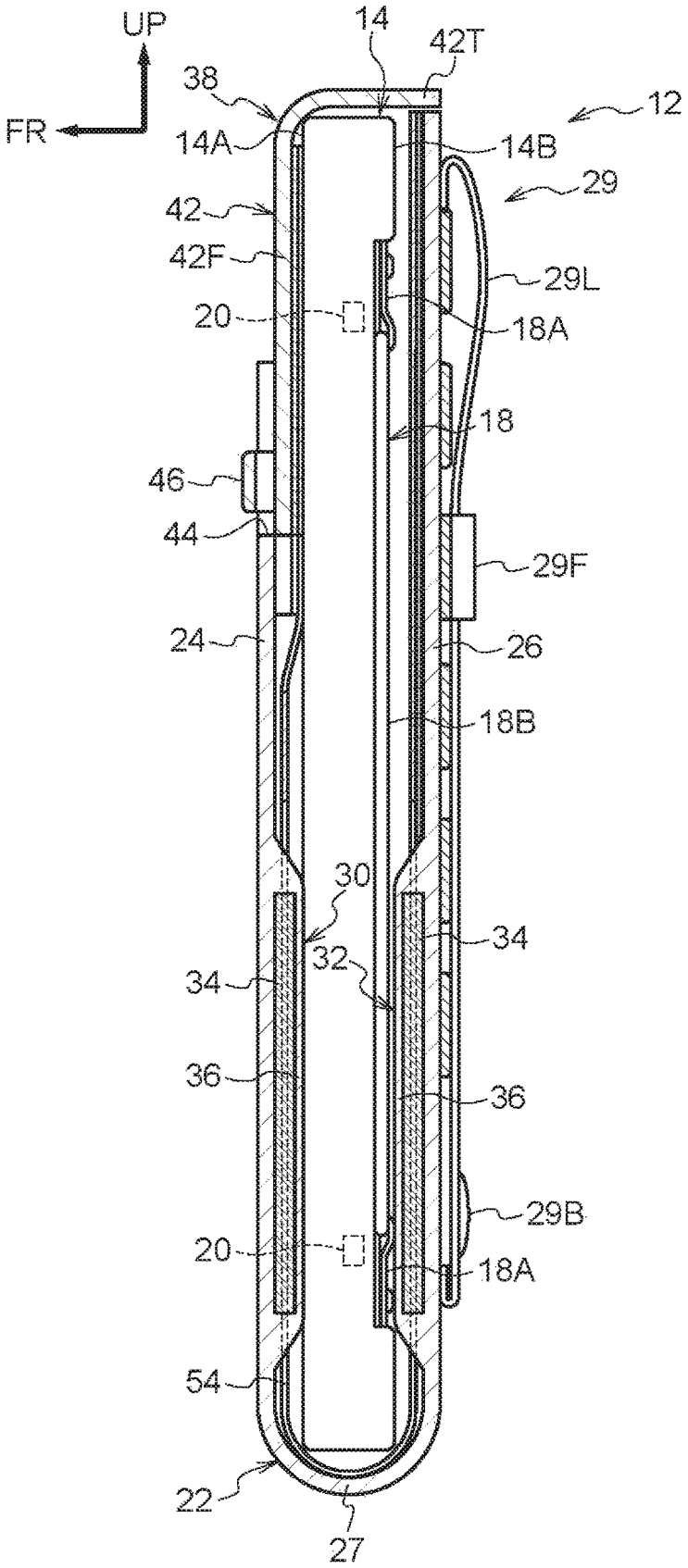
FIG. 9 is a vertical cross-section illustrating a storage case of the first exemplary embodiment, together with a storage item.

As illustrated in FIG. 9, in a case in which the front and back of the storage item 14 are stored in the storage case 12 in the opposite orientation to the example illustrated in FIG. 1, the positions of the magnetic sensors 20 are positioned near the rear plate 26. Even in such cases, the magnetic flux density between the magnet members 30, 32 can be reliably detected by the magnetic sensors 20.

In contrast thereto, the magnetic flux density outside the storage case 12, for example, is lower than that between the magnet bodies 34. Thus, the magnetic sensors 20 can be suppressed from detecting the magnetic flux density generated by the magnet members 30, 32 even if, in a case of being outside the storage case 12, the magnetic sensors 20 of the storage item 14 come close to the magnet members 30, 32.

In the present exemplary embodiment, the exposure hole 50 is provided in the fold portion 48 of the pull-out member 38. In the folded state of the pull-out member 38 at the fold portion 48, the exposure hole 50 forms the indented portion 52 that is indented downward. The position of the indented portion 52 corresponds to the position of the cutout portion 44, and exposes the extraction section 18 of the storage item 14 over a wider range. This facilitates an operation to hook a finger or the like onto the extraction section 18, and facilitates pulling out the storage item 14.

In the state in which the pull-out member 38 has been folded at the fold portion 48, part of the pull-out member 38 (a portion close to the fold portion 48) enters a state caught on the insertion opening 22M of the case body 22 (the upper end 24T of the front plate 24). This enables the pull-out member 38 to be suppressed from moving toward the inside of the case body 22.

In a case in which the storage item 14 is stored inside the storage case 12, and in a state in which the pull-out member 38 has been folded at the fold portion 48, the storage item 14 is inserted between the fixed portion 40B and the movable portion 40A of the inner cloth 40.

The length directions of the magnet bodies 34 run along the insertion direction (arrow S1 direction). As is clear from FIG. 7, even in a state in which the storage item 14 is simply placed onto the continuation portion 40C of the inner cloth 40, the magnetic sensors 20 are positioned in a range reached by the magnetic force of the magnet bodies 34. Namely, in the state in which the pull-out member 38 has been folded at the fold portion 48, the storage item 14 can be transitioned to the energy saving state simply by inserting the storage item 14 into the storage case 12.

The folding of the pull-out member 38 at the fold portion 48 is then unfolded (placing the movable portion 40A in a flat plane shape). Since the pull-out member 38 then adopts an orientation not facing the front plate 24, the movable portion 40A is capable of moving along the arrow A2 direction. The storage item 14 can be stored inside the storage case 12 by being pressed in the arrow A2 direction. The pull-out member 38 (inner cloth 40) has a structure in which there is continuity between the movable portion 40A and the fixed portion 40B through the continuation portion 40C. This enables the continuation portion 40C to be pressed and the movable portion 40A to be moved along the arrow A2 direction by the insertion operation of the storage item 14 into the storage case 12.

In particular, the continuation portion 40C and the movable portion 40A (the portion where the pull-out lid 42 is not attached) are flexible. Thus, deformation of the pull-out member 38 (inner cloth 40) easily occurs in a case in which the storage item 14 has pressed the continuation portion 40C downward under gravity, enabling the storage item 14 to be stored in the storage case 12.

In a case in which the storage item 14 is in the fully stored state and an upper portion of the storage case 12 is closed off by the pull-out lid 42, the storage item 14 can be suppressed from unintentionally coming out of the storage case 12 (the storage item 14 can be suppressed from flying out due to up-down movement of the storage case 12, for example).

In the above description, the magnet members 30, 32 have been given as examples of a detected member; however, the detected member is not limited to the magnet members 30, 32. There is also no limitation to the magnetic sensors 20 as sensors of the storage item. It is sufficient that the detected member is a member that is detected by a sensor of the storage item in a state in which the storage item is stored inside the case body.

All publications, patent applications and technical standards mentioned in the present specification are incorporated by reference in the present specification to the same extent as if the individual publication, patent application, or technical standard was specifically and individually indicated to be incorporated by reference.

An exemplary embodiment of technology described in the present specification has been explained above; however, the technology described in the present application is not limited to the above description, and obviously various other modifications may be implemented within a range not departing from the spirit of the present application.

In the technology described in the present specification, a pull-out member, which moves a storage item toward the outside upon being pulled out from a case body, is formed with a fold portion along which the pull-out member is folded to expose an extraction section of the case body.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

All cited documents, patent applications and technical standards mentioned in the present specification are incorporated by reference in the present specification to the same extent as if the individual cited documents, patent applications and technical standards were specifically and individually incorporated by reference in the present specification.

What is claimed is:

1. A storage case comprising:

a case body that stores a storage item;

a pull-out member that, upon being pulled out from the case body, moves the storage item stored in the case body toward an outside of the case body;

a fold portion that is provided at the pull-out member, the pull-out member being folded at the fold portion and separated from an extraction section of the storage item, so as to expose the extraction section in a state in which the extraction section of the storage item is positioned outside the case body; a cutout portion that is provided at the case body and that exposed a handle portion provided at the pull-out member; and an exposure hole that is provided at the fold portion of the pull-out member, and that widens an exposed range of the extraction section at a position corresponding to the cutout portion in a case in which the pull-out member is folded at the fold portion.

2. The storage case of claim 1, wherein the pull-out member includes:

a movable portion that is disposed along one side of an inner surface of the case body and moves along an insertion direction of the storage item;

a fixed portion that is fixed to another side of the inner surface of the case body; and a continuation portion that links the fixed portion and the movable portion together at a leading end side in the insertion direction of the storage item into the case body.

3. The storage case of claim 2, wherein the fold portion is provided at the movable portion.

4. The storage case of claim 3, wherein the movable portion includes a pull-out lid that is positioned outside the case body in a state in which the extraction section has moved to outside the case body.

5. The storage case of claim 4, wherein the pull-out member hooks onto an insertion opening of the case body in a state in which the pull-out member has been folded at the fold portion.

6. The storage case of claim 4, wherein the continuation portion is flexible.

* * * * *